US011790775B2

(12) United States Patent
Peranandam et al.

(10) Patent No.: US 11,790,775 B2
(45) Date of Patent: Oct. 17, 2023

(54) METHODS AND SYSTEMS FOR INDICATING A DRIVING SITUATION TO EXTERNAL USERS

(71) Applicant: GM GLOBAL TECHNOLOGY OPERATIONS LLC, Detroit, MI (US)

(72) Inventors: Prakash Mohan Peranandam, Rochester Hills, MI (US); Ramesh Sethu, Troy, MI (US); Arun Adiththan, Sterling Heights, MI (US); Joseph G D Ambrosio, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 199 days.

(21) Appl. No.: 17/446,521

(22) Filed: Aug. 31, 2021

(65) Prior Publication Data

US 2023/0065282 A1 Mar. 2, 2023

(51) Int. Cl.
*G08G 1/00* (2006.01)
*G08G 1/09* (2006.01)
*G08G 1/01* (2006.01)

(52) U.S. Cl.
CPC ..... *G08G 1/092* (2013.01); *G08G 1/0145* (2013.01)

(58) Field of Classification Search
CPC ..... G08G 1/092; G08G 1/0145
See application file for complete search history.

(56) References Cited

U.S. PATENT DOCUMENTS

2023/0065282 A1* 3/2023 Peranandam et al. . G08G 1/092
2023/0072423 A1* 3/2023 Osborn et al. ..... A61B 5/1107

* cited by examiner

*Primary Examiner* — Ian Jen
(74) *Attorney, Agent, or Firm* — Lorenz & Kopf LLP

(57) ABSTRACT

Methods and systems are provided for indicating a driving situation including at least one vehicle. The system includes a first processor, a second processor and an external device. A first processor obtains driving information, encodes the driving information and communicates the encoded driving information to the second processor. The second processor receives and decodes the encoded driving information. The second processor further allocates a predefined indication pattern to the decoded driving information, wherein the predefined indication pattern includes a graphical representation of an upcoming driving event involving the vehicle. An external device visualizes a current driving situation including the vehicle together with the predefined indication pattern.

20 Claims, 7 Drawing Sheets

METHODS AND SYSTEMS FOR INDICATING A DRIVING SITUATION TO EXTERNAL USERS

INTRODUCTION

The technical field generally relates to the indication of current and upcoming driving situations involving vehicles. More particularly it relates to a method and a system for indicating to a user of an external device a driving situation including at least one vehicle.

Driving a vehicle in a given traffic situation frequently requires the vehicle drivers to adapt their driving behaviors. It is important for a vehicle driver to receive accurate traffic situation information, for example driving information of other vehicles, in order to initiate a required driving maneuver and to avoid critical situations. The requirement to receive accurate driving information may be important for navigation purposes and becomes even more important for navigation scenarios in which the vehicle navigates through densely populated areas, for example large cities, in which multiple different features and objects in the surrounding environment must be distinguished. Usually, on-board sensor systems, like camera systems, Lidars, radars, etc. are used to provide information of the environment which can support a driver when driving the vehicle through this environment. In autonomous driving systems, this information can be used to automatically initiate driving operations without any interaction of the driver. However, this information generally takes into account only a current or real time traffic situation as it is detected by the corresponding sensor systems.

Accordingly, it is desirable to provide an improved indication of upcoming driving events based on a current driving situation. In addition, it is desirable to provide an enhanced communication and indication of such upcoming driving events to a user approaching the current driving situation. Furthermore, other desirable features and characteristics of the present invention will become apparent from the subsequent detailed description and the appended claims, taken in conjunction with the accompanying drawings and the foregoing technical field and background.

SUMMARY

A method is provided for indicating a driving situation including a vehicle to an external device. The method includes obtaining, by a first processor, driving information of the vehicle, wherein the driving information includes information about an upcoming driving event involving the vehicle, which for example can be a pod vehicle. The driving information may further comprise vehicle information. The method further includes encoding, by the first processor, the driving information to provide encoded driving information. The method further includes communicating, by the first processor, the encoded driving information to the external device. The method further includes receiving the encoded driving information at the external device and providing the encoded driving information to a second processor. The method further includes decoding, by the second processor, the encoded driving information to provide decoded driving information. The method further includes allocating, by the second processor, a predefined indication pattern to the decoded driving information, wherein the predefined indication pattern includes a graphical representation of the upcoming driving event involving the vehicle. The method further includes visualizing, at the external device, a current driving situation including the vehicle together with the predefined indication pattern.

In an exemplary embodiment, the information about the upcoming driving event is determined based on a current driving operation of the vehicle and an intended driving operation of the vehicle.

In an exemplary embodiment, the first processor encodes the driving information using a bit vector, wherein the bit vector includes information about the current driving operation of the vehicle and the intended driving operation of the vehicle.

In an exemplary embodiment, the information about the upcoming driving event includes information about a number of vehicles involved in the upcoming driving event, a type of the involved vehicle or vehicles, and a target position of the involved vehicles.

In an exemplary embodiment, communicating the encoded driving information to the external device includes communicating the encoded driving information using a visual signal (e.g., Visible Light Communication (VLC)), an acoustic signal, a radio frequency signal, an infrared signal, a visual projection or a combination thereof.

In an exemplary embodiment, the external device is a mobile platform, e.g., an external vehicle or an external handheld device, in the environment of the vehicle and spatially separated from the vehicle. In the following the term "external" may reference a non-participating entity that receives the encoded driving information from the participating entities, such as the vehicle or multiple vehicles involved or from traffic signals, traffic lights, bikers, pedestrians, etc., and therefore participating in the driving situation.

In an exemplary embodiment, the external device comprises the second processor.

In an exemplary embodiment, a server that is spatially separated from the external device or a storage medium that is integrated into the external device provides a list of possible predefined indication patterns, wherein each predefined indication pattern of the list of predefined indication patterns is referenced to a particular driving information.

In an exemplary embodiment, allocating the predefined indication pattern to the decoded driving information includes selecting a predefined indication pattern from the list of possible predefined indication patterns.

In an exemplary embodiment, the predefined indication pattern is provided by the second processor using a Markov decision process (e.g., a Partially Observable Markov decision process (POMDP)) or a deep learning process or both.

In an exemplary embodiment, the predefined indication pattern is indicative of a type of the graphical representation of the upcoming driving event involving the vehicle.

In an exemplary embodiment, the current driving situation including the vehicle together with the predefined indication pattern is visualized at a display of the external device using augmented reality.

In an exemplary embodiment, the driving situation including the vehicle is visualized as a real-world environment enhanced by the predefined indication pattern.

In an exemplary embodiment, the second processor further determines a projection zone that defines a region at the display in which the predefined indication pattern is visualized.

In an exemplary embodiment, the predefined indication pattern displayed within the projection zone is a visualization on the display indicating a location with respect to the real-world environment in which the vehicle will be maneuvering during the upcoming driving event.

In an exemplary embodiment, the second processor determines a point in time at which the predefined indication pattern is to be visualized at the external device based on a current traffic situation around external device and/or around the vehicle.

In an exemplary embodiment, the second processor determines a reliability of the visualized predefined indication pattern, wherein the reliability is indicative of a quality of the driving information obtained by the first processor.

In an exemplary embodiment, a leader vehicle and a follower vehicle are involved in the current driving situation. The driving information includes information about a digital towing operation including the leader vehicle and the follower vehicle. The predefined indication pattern may indicate an upcoming maneuver of the follower vehicle.

A system is provided for indicating a driving situation including a vehicle. The system includes a first processor, a second processor and an external device. The first processor obtains driving information of the vehicle, wherein the driving information includes information about an upcoming driving event involving the vehicle, which for example can be a pod vehicle. The driving information may further comprise vehicle information. The first processor encodes the driving information to provide encoded driving information and communicates the encoded driving information to the second processor. The second processor receives the encoded driving information and decodes the encoded driving information to provide decoded driving information. The second processor further allocates a predefined indication pattern to the decoded driving information, wherein the predefined indication pattern includes a graphical representation of the upcoming driving event involving the vehicle. The external device visualizes, for example via a display, a current driving situation including the vehicle together with the predefined indication pattern.

In an exemplary embodiment, the external device is an external vehicle and the second processor is located on the external vehicle.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description. As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the systems described herein is merely exemplary embodiments of the present disclosure.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

Figure 1:
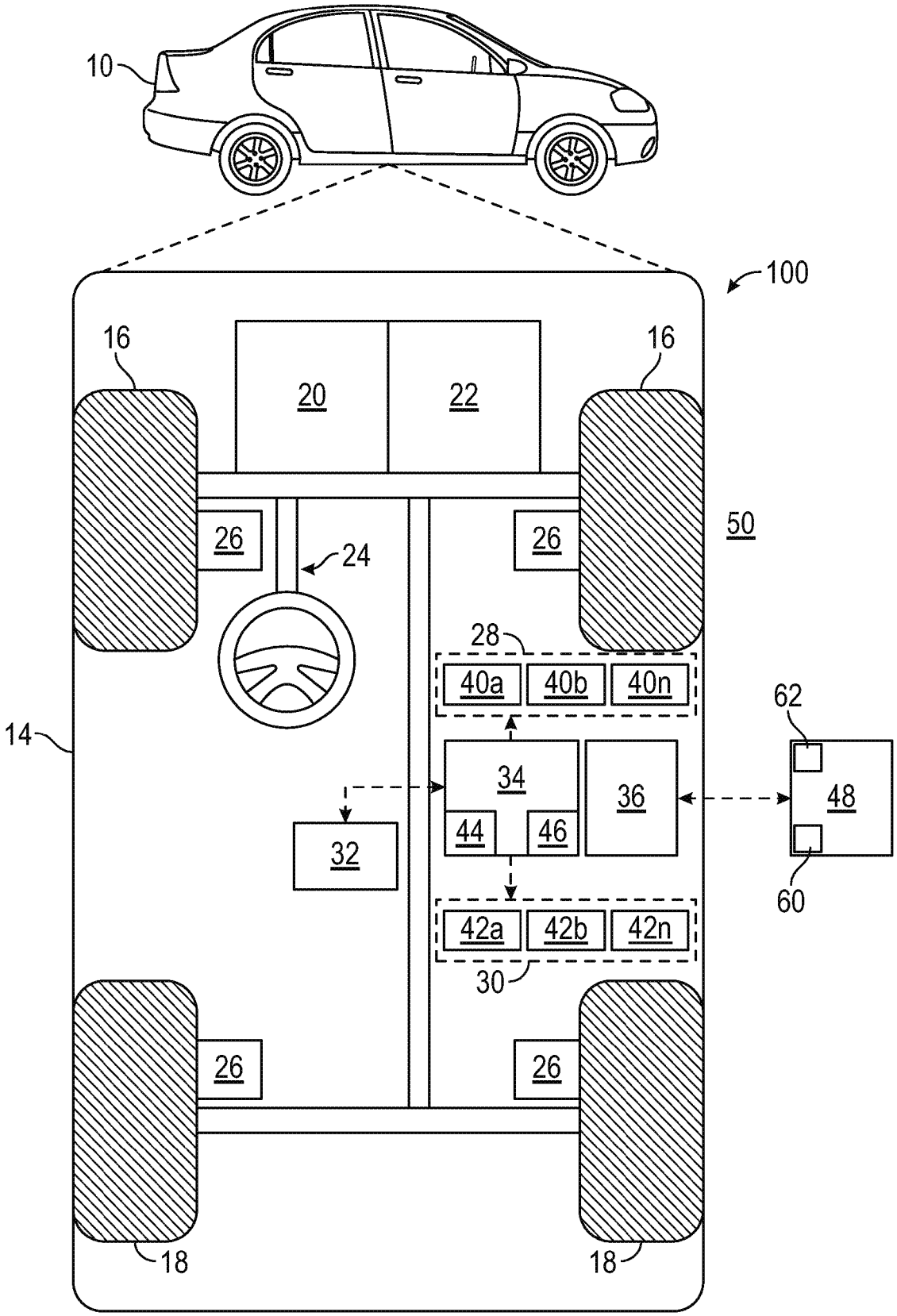
FIG. 1 is a schematic representation of a vehicle having a first processor for processing driving information of the vehicle and a communication system for communicating encoded driving information to an external device, in accordance with an embodiment.

With reference to FIG. 1, a vehicle 10 is shown in accordance with various embodiments. The vehicle 10 generally includes a chassis 12, a body 14, front wheels 16, and rear wheels 18. The body 14 is arranged on the chassis 12 and substantially encloses components of the vehicle 10. The body 14 and the chassis 12 may jointly form a frame. The wheels 16 and 18 are each rotationally coupled to the chassis 12 near a respective corner of the body 14.

In various embodiments, the vehicle 10 is an autonomous vehicle. The autonomous vehicle 10 is, for example, a vehicle that is automatically controlled to carry passengers from one location to another. The vehicle 10 is depicted in the illustrated embodiment as a passenger car, but it should be appreciated that any other vehicle including motorcycles, trucks, sport utility vehicles (SUVs), recreational vehicles (RVs), marine vessels, aircraft, etc., can also be used. In an exemplary embodiment, the autonomous vehicle 10 is a so-called Level Four or Level Five automation system. A Level Four system indicates "high automation", referring to the driving mode-specific performance by an automated driving system of all aspects of the dynamic driving task, even if a human driver does not respond appropriately to a request to intervene. A Level Five system indicates "full automation", referring to the full-time performance by an automated driving system of all aspects of the dynamic driving task under all roadway and environmental conditions that can be managed by a human driver.

As shown, the autonomous vehicle 10 generally includes a propulsion system 20, a transmission system 22, a steering system 24, a brake system 26, a sensor system 28, an actuator system 30, at least one data storage device 32, at least one controller 34, and a communication system 36. The propulsion system 20 may, in various embodiments, include an internal combustion engine, an electric machine such as a traction motor, and/or a fuel cell propulsion system. The transmission system 22 is configured to transmit power from the propulsion system 20 to the vehicle wheels 16 an 18 according to selectable speed ratios. According to various embodiments, the transmission system 22 may include a step-ratio automatic transmission, a continuously-variable transmission, or other appropriate transmission. The brake system 26 is configured to provide braking torque to the vehicle wheels 16 and 18. The brake system 26 may, in various embodiments, include friction brakes, brake by wire, a regenerative braking system such as an electric machine, and/or other appropriate braking systems. The steering system 24 influences a position of the of the vehicle wheels 16 and 18. While depicted as including a steering wheel for illustrative purposes, in some embodiments contemplated within the scope of the present disclosure, the steering system 24 may not include a steering wheel.

The sensor system 28 includes one or more sensing devices 40*a*-40*n* that sense observable conditions of the exterior environment and/or the interior environment of the autonomous vehicle 10. The sensing devices 40*a*-40*n* can include, but are not limited to, radars, lidars, global positioning systems, optical cameras, thermal cameras, ultrasonic sensors, and/or other sensors. The actuator system 30 includes one or more actuator devices 42*a*-42*n* that control one or more vehicle features such as, but not limited to, the propulsion system 20, the transmission system 22, the steering system 24, and the brake system 26. In various embodiments, the vehicle features can further include interior and/or exterior vehicle features such as, but are not limited to, doors, a trunk, and cabin features such as air, music, lighting, etc. (not numbered).

The communication system 36 is configured to wirelessly communicate information to and from other entities 48, e.g., external devices 48 or so-called non-participating devices 48, such as but not limited to, other vehicles ("V2V" communication,) infrastructure ("V2I" communication), remote systems, and/or personal devices such as mobile or handheld devices. The external devices 48 may include a processor 60 that executes at least a part of a method as will be described in more detail herein. In an exemplary embodiment, the communication system 36 is a wireless communication system configured to communicate via a wireless local area network (WLAN) using IEEE 802.11 standards or by using cellular data communication. However, additional or alternate communication methods, such as a dedicated short-range communications (DSRC) channel, are also considered within the scope of the present disclosure. DSRC channels refer to one-way or two-way short-range to medium-range wireless communication channels specifically designed for automotive use and a corresponding set of protocols and standards. In an exemplary embodiment, the communication system 36 is configured to communicate encoded driving information. This encoded driving information may be communicated via at least one of a visual signal like a visual light or illumination signal, an acoustic signal like a sound wave signal, a radio frequency signal, and an infrared signal. As such the communication system 36 may include a light transmission unit having one or more light sources such as pre-installed vehicle lights, LED lights, light bulbs, etc. The communication system 36 may additionally or alternatively include an infrared light source for transmitting the infrared signal and/or a speaker for emitting the acoustic signal. The communication system 36 may additionally or alternatively include a radio frequency transmitter for transmitting the radio frequency signal. The encoding of the driving information to be communicated to an external device 48 may be achieved, for example, by transmitting a predetermined signal sequence, signal frequency, signal duration or signal strength, which is representative for the encoded information.

The data storage device 32 stores data for use in automatically controlling the autonomous vehicle 10. In various embodiments, the data storage device 32 stores defined maps of the navigable environment. In various embodiments, the defined maps may be predefined by and obtained from a remote system. For example, the defined maps may be assembled by the remote system and communicated to the autonomous vehicle 10 (wirelessly and/or in a wired manner) and stored in the data storage device 32. As can be appreciated, the data storage device 32 may be part of the controller 34, separate from the controller 34, or part of the controller 34 and part of a separate system.

The controller 34 includes at least one processor, herein also referred to as the first processor 44, and a computer readable storage device or media 46. The first processor 44 can be any custom made or commercially available processor, a central processing unit (CPU), a graphics processing unit (GPU), an auxiliary processor among several processors associated with the controller 34, a semiconductor based microprocessor (in the form of a microchip or chip set), a macroprocessor, any combination thereof, or generally any device for executing instructions. The computer readable storage device or media 46 may include volatile and nonvolatile storage in read-only memory (ROM), random-access memory (RAM), and keep-alive memory (KAM), for example. KAM is a persistent or non-volatile memory that may be used to store various operating variables while the first processor 44 is powered down. The computer-readable storage device or media 46 may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 34 in controlling the autonomous vehicle 10. The first processor 44 may execute at least a part of the method described with reference to FIG. 2 below. The processor 60 of the external device 48 will, in the following, be referred to as the second processor 60 that executes at least another part of the method described with reference to FIG. 2 below. This method as it is executed by the first and second processors 44, 60 (FIG. 2) will provide an indication of a driving situation including the vehicle 10 of FIG. 1 to the external device 48.

Figure 2:
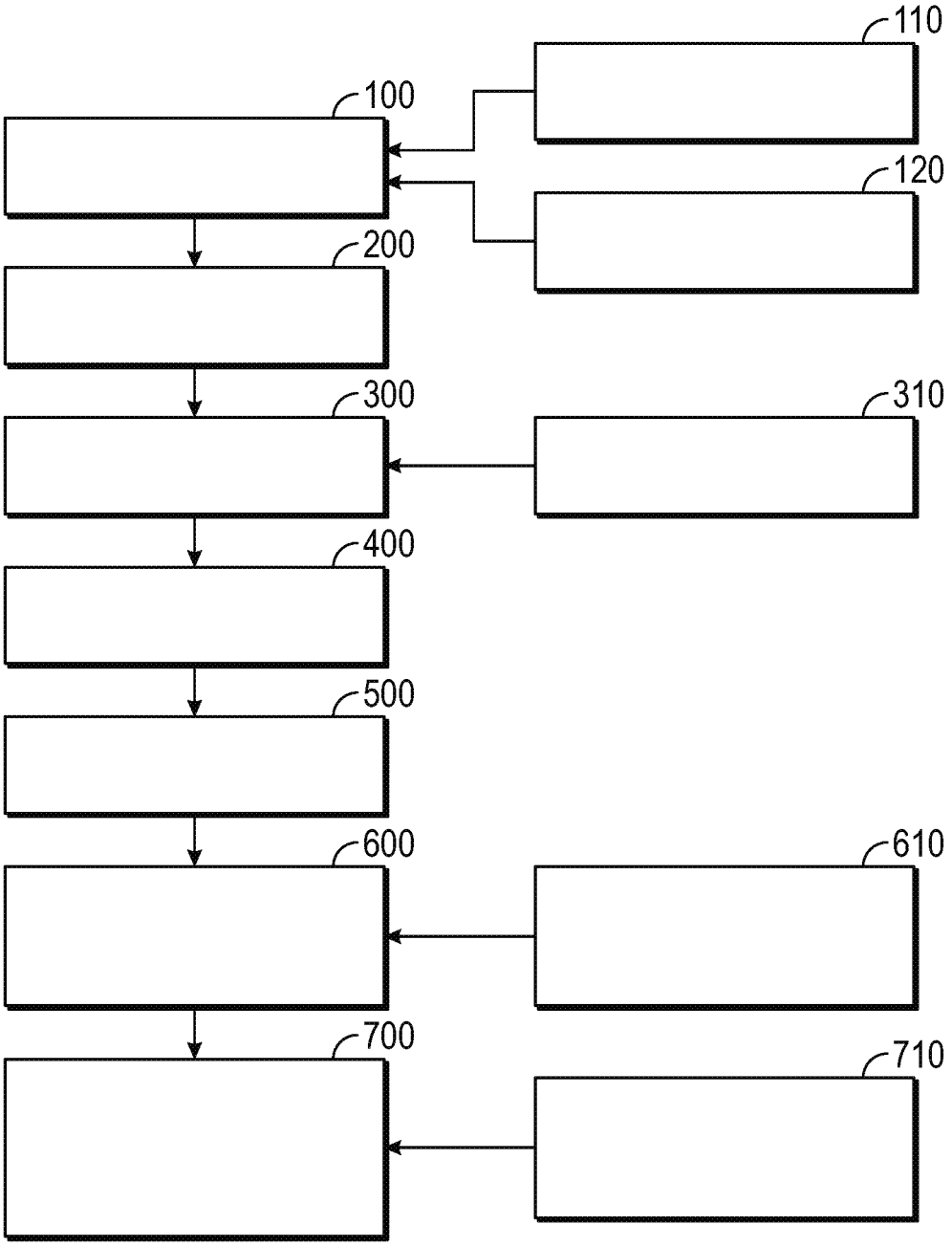
FIG. 2 is a flowchart showing the steps for implementing a method of indicating a driving situation including the vehicle of FIG. 1 to an external device, in accordance with an embodiment.

To execute at least a part of the method of FIG. 2, the first processor 44, may execute instructions which may include one or more separate programs, each of which comprises an ordered listing of executable instructions for implementing logical functions. The instructions, when executed by the first processor 44, receive and process signals from the sensor system 28, perform logic, calculations, methods and/or algorithms for automatically controlling the components of the autonomous vehicle 10, and generate control signals to the actuator system 30 to automatically control the components of the autonomous vehicle 10, for example the communication system 36, based on the logic, calculations, methods, and/or algorithms. Although only one controller 34 is shown in FIG. 1, embodiments of the autonomous vehicle 10 can include any number of controllers 34 that communicate over any suitable communication medium or a combination of communication mediums and that cooperate to process the sensor signals, perform logic, calculations, methods, and/or algorithms, and generate control signals to automatically control features of the autonomous vehicle 10.

In various embodiments, one or more instructions of the controller 34 and/or the first processor 44 shown in FIG. 1 are embodied by: obtaining driving information of the vehicle 10, wherein the driving information includes information about an upcoming driving event involving the vehicle 10; encoding the driving information in order to provide encoded driving information; and communicating the encoded driving information to the external device 48.

Although only one external device 48 is shown in FIG. 1, embodiments of the operating environment 50 can support any number of external devices 48, including multiple user devices 48 owned, operated, or otherwise used by one person. Each external device 48 supported by the operating environment 50 may be implemented using any suitable hardware platform. In this regard, the external device 48 can be realized in any common form factor including, but not limited to: a desktop computer; a mobile computer (e.g., a tablet computer, a laptop computer, or a netbook computer); a smartphone; a video game device; a digital media player; a piece of home entertainment equipment; a digital camera or video camera; a wearable computing device (e.g., smart watch, smart glasses, smart clothing); or the like. Each external device 48 supported by the operating environment 50 may be realized as a computer-implemented or computer-based device having the hardware, software, firmware, and/or processing logic needed to carry out the various techniques and methodologies described herein. For example, the external device 48 includes the second processor 60, for example a microprocessor in the form of a programmable device that includes one or more instructions stored in an internal memory structure and applied to receive binary input to create binary output. In some embodiments, the external device 48 includes a GPS module capable of receiving GPS satellite signals and generating GPS coordinates based on those signals. In other embodiments, the external device 48 includes cellular communications functionality such that the device carries out voice and/or data communications over a communication network using one or more cellular communications protocols, as are discussed herein. In various embodiments, the external device 48 includes a visual display 62, such as a graphical display, a touch-screen, an augmented reality (AR) display, a Heads-up-Display (HUD), other display types, or any combinations thereof.

In an exemplary embodiment, the external device 48 is a further vehicle 48 spatially separated from the vehicle 10 described with reference to FIG. 1. To distinguish this further vehicle from the vehicle 10 of FIG. 1 which is involved in the driving situation, the further vehicle 48 will be referred to as the external vehicle 48. The external vehicle 48 may have the same components, features, characteristics and functionalities as the vehicle 10 described with reference to FIG. 1. The external vehicle 48 may include a visual display 62, such as a graphical display, a touch-screen, an augmented reality (AR) display, a Heads-up-Display (HUD), other display types, or any combinations thereof. The external vehicle 48 may thus indicate via the visual display 62 a current driving situation including the vehicle 10 together with a predefined indication pattern that includes a graphical representation of an upcoming driving event involving the vehicle 10, for example a graphical representation of a space that will be used by the vehicle 10 within an upcoming point in time.

With reference now to FIG. 2 a flowchart showing the steps for executing a method of indicating a driving situation to an external device will be described. The method may be executed by the first processor 44 of the at least one vehicle 10 shown in FIG. 1 in cooperation with the second processor 60 of the external device 48 also shown in FIG. 1. It is possible that a part of the method will be executed by the first processor 44 and another part of the method will be executed by the second processor 60. The different method steps are represented by specified blocks in FIG. 2. At block 100, the first processor obtains driving information of the at least one vehicle 10, the driving information including information about an upcoming driving event involving the at least one vehicle 10. To determine the driving information at block 100, information about a current driving operation or driving state of the vehicle 10, e.g., a parking operation, a cruising operation, a digital towing operation, etc., may be determined at block 110. Furthermore, to determine the driving information at block 100, information about an intended driving operation or intended driving state of the vehicle 10, e.g., an intended de-parking operation, an intended stopping operation, an intended lane change operation, etc., may be determined at block 120. The information about the upcoming driving event involving the vehicle 10 can then be determined based on the determined current driving operation from block 110 and the intended driving operation from block 120. All these determinations may be provided by the first processor 44. Based on information about the upcoming driving event, the driving information can then be determined by the first processor 44 at block 100. At block 200, the first processor 44 encodes the driving information in order to provide encoded driving information. The encoding of the driving information may be carried out by defining characteristics of the signal to be communicated to the external device 48. For example, the encoding of the driving information to be communicated to the external device 48 may be achieved by setting a predetermined signal sequence, signal frequency, signal duration, signal strength, and/or by combining any of these signal characteristics, such that the appearance of the signal as received by the external device 48 is a unique representation of the encoded information. After encoding the driving information at block 200, the first processor 44 communicates the encoded driving information to the external device 48, at block 300. Before communicating the encoded driving information via the signal, a communication type can be selected at block 310, wherein the communication type may be represented at least one of a visual communication signal, an acoustic communication signal, radio frequency communication signal and an infrared communication signal. At block 400, the external device 48 receives the encoded driving information, i.e., the communication signal, and provides this encoded driving information to the second processor 60 which is either part of the external device 48 as shown in FIG. 1 or is spatially separated from the external device 48. At block 500, the second processor 60 decodes the encoded driving information in order to provide decoded driving information. At block 600, the second processor allocates a predefined indication pattern to the decoded driving information, wherein the predefined indication pattern includes a graphical representation of the upcoming driving event involving the vehicle 10. Before allocating at block 600, the second processor 60 of the external device 48 or another remote processor or remote server spatially separated from the second processor 60 and having a data storage may provide a list of possible predefined indication patterns at block 610, wherein each predefined indication pattern of the list of predefined indication patterns is referenced to a particular driving information. This may be a look-up-table or a register in which different particular driving information is referenced to corresponding predefined indication patterns. In this case, allocating the predefined indication pattern to the decoded driving information includes selecting a predefined indication pattern from the list of possible predefined indication patterns. However, it is also possible that the provision of the predefined indication pattern at block 610 is executed using at least one of a Markov decision process and a deep learning process. For example, a POMDP (Partially Observable Markov Decision Process) model or a DNN (Deep Neural Network) may be used to decide on the best type of graphical indications or representations to be allocated to a given situation, i.e., to a particular decoded driving information. Such techniques may be used if there are multiple options for a given encoded driving information based on a set of inputs. Therefore, the predefined indication pattern that is allocated at block 600 is indicative of a type of the graphical representation of the upcoming driving event involving the vehicle 10. The POMDP model may determine a specific graphical projection, i.e., indication pattern, based on different input parameters. These input parameters may include, but are not limited to, traffic observations in the environment of the vehicle 10 and/or the external vehicle 48, road details in the environment of the vehicle 10 and/or the external vehicle 48, vehicle capabilities of the vehicle 10 and/or the external vehicle 48, rules and indication patterns, i.e., indication options. For example, the POMDP model may distinguish between heavy traffic situations and light traffic situations such that the indication of the predefined indication pattern varies between those traffic situations. At block 700, a current driving situation including the vehicle 10 together with the predefined indication pattern is visualized at the external device 48. The visualization may be provided at the display 62 (FIG. 1) of the external device 48 using augmented reality (AR). When using augmented reality, the driving situation including the vehicle 10 may be visualized as a real-world environment 50 (cf. FIG. 3) in which the vehicle 10 is located, enhanced by the predefined indication pattern. In other words, the real-world scene 50 including the vehicle 10, as seen from a user of the external device 48, will be overlaid or superimposed with the predefined indication pattern. Additionally, a projection zone can be determined at block 710, the projection zone defining a region on the display in which the predefined indication pattern is visualized. In an example, the predefined indication pattern displayed within the projection zone is a visualization on the display indicating a location with respect to the real-world environment, as seen from a user of the external device 48, in which the at least one vehicle will be maneuvering during the upcoming driving event. Furthermore, a visualization type can be selected based on the provided predefined indication pattern. The type of visualization and its graphical representation, for example a text or a graphical content like dots, lines, rectangles, polygons, etc., on the display may be customized or set by the user of the external device 48. The visualization executed at block 700 will be described in more detail with reference to FIG. 3 below.

In an exemplary embodiment, the second processor 60 may further determine a point in time at which the predefined indication pattern is to be visualized at the external device 48 based on a current traffic situation around the vehicle 10 and/or external device 48. This determination not shown in FIG. 2 may be executed between block 600 and block 700.

In a further exemplary embodiment, the second processor 60 may determine a reliability, for example a reliability value or reliability character, of the visualized predefined indication pattern, wherein the reliability is indicative of a quality of the driving information obtained by the first processor 44. This may apply if the driving information communicated to the external device 48 is of low quality, for example if the first processor is not able to collect sufficient or sufficiently reliable driving information at block 100. In this case, the reliability determined by the second processor 60 may be additionally indicated, i.e., visualized, on the external device 48 such that a user of the external device 48 can readily derive a reliability of the visualized information, for example whether the visualized predefined indication pattern is trustworthy.

Figure 3:
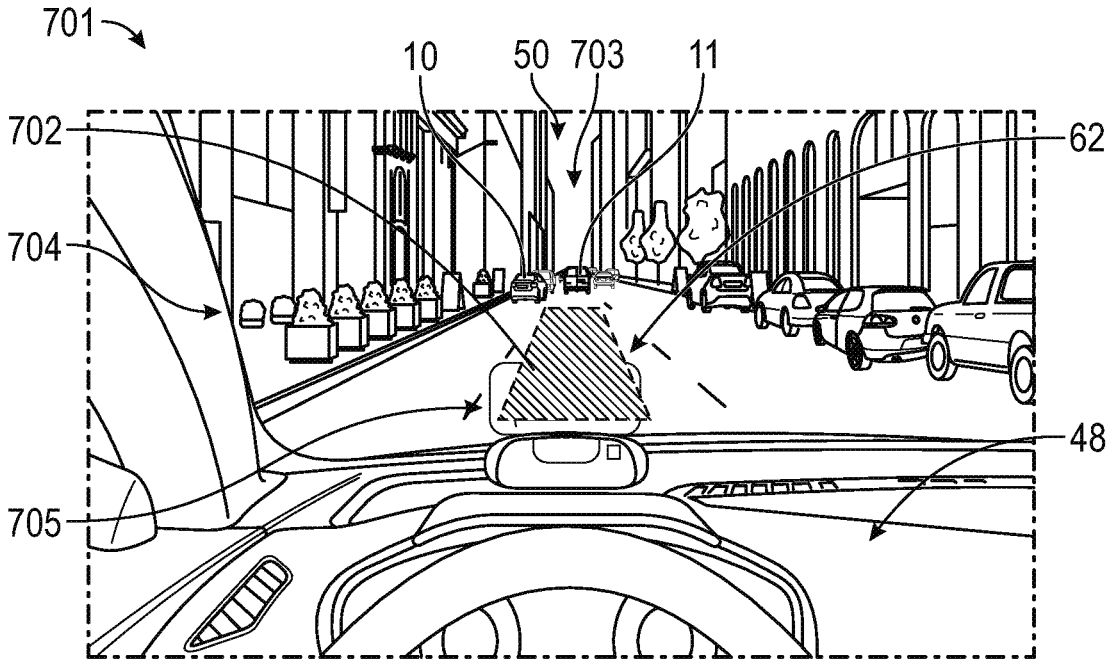
FIG. 3 illustrates a visualization, as seen from a user of the external device of FIG. 1, indicating a driving situation including the vehicle of FIG. 1, in accordance with an embodiment.

FIG. 3 illustrates a visualization 701 on a display 62, which in this embodiment is a Heads-up-Display, as seen by a user of the external device 48 of FIG. 1. The display 62 is integrated in or is part of the external device 48. In this embodiment, the external device 48 is an external vehicle 48 driving on the same road as vehicle 10. Vehicle 10 is driving on a left lane in front of the external vehicle in the current driving situation 703. The current driving situation 703 is represented by a real-world scene 50 as it is seen by a driver of the external vehicle 48 through the front shield window 704 of the external vehicle 48. The visualization 701 may be the visualization as described with reference to block 700 of FIG. 2 above. The visualization 701 indicates the driving situation 703 including the vehicle 10 driving in front. The first processor 44 of vehicle 10 (cf. FIG. 1) may determine that the vehicle 10 is currently in a digital towing operation with another vehicle 11, wherein the other vehicle 11 is the leader vehicle and the vehicle 10 is the follower vehicle. Object detection or recognition techniques may be included in this determination process. After this determination by the first processor of vehicle 10, further information of the digital towing operation can be determined including an upcoming driving event of vehicle 10 that is caused by the digital towing operation. The upcoming driving event may indicate that vehicle 10 will perform a lane change to the right within a given time period such that vehicle 10 will be driving on the same lane and in front of external vehicle 48. This upcoming driving event may then be communicated by the first processor of vehicle 10 to the external vehicle 48 such that the second processor 60 of the external vehicle 48 (cf. FIG. 1) may determine an appropriate predefined indication pattern 702 indicating the lane change maneuver of vehicle 10. The predefined indication pattern 702 is a graphical representation as shown in FIG. 3 that indicates the current driving situation 703, i.e., the digital towing operation including the vehicles 10 and 11, and/or indicates an upcoming driving event involving the vehicles 10 and 11. In this case, the predefined indication pattern 702 indicates that a digital towing operation is in progress and reserves a virtual area or space projected into the real-world scene 50 of the current driving situation 703 using augmented reality. Thus, the current driving situation 703 includes an indication of the vehicle 10 together with the predefined indication pattern 702 on the display 62 of the external vehicle 48. In particular, the driving situation 703 including the vehicle 10 is visualized within the real-world environment 50 enhanced by the predefined indication pattern 702. Before visualizing, the second processor determines the projection zone 705 that defines a region at the display 62 in which the predefined indication pattern 702 is to be visualized. The predefined indication pattern 702 displayed within the projection zone 705 is a visualization on the display 62 indicating a location with respect to the real-world environment 50 in which the vehicle 10 may be maneuvering during the upcoming driving event. The predefined indication pattern 702 may include a character string to indicate to the user of the external vehicle 48 in which type of driving situation 703 the vehicle 10 is involved, here a digital towing operation. However, it will be appreciated that FIG. 3 merely represents an exemplary type of indication and that other types of indications are possible.

In view of the above descriptions, the systems and methods described herein can be used in a vehicle, for example vehicle 10 of FIG. 1 above, to communicate a driving intention and the corresponding information to non-participating parties or other entities, such as the external device 48. Such non-participating parties or external entities may be vehicles, pedestrians, etc. using the encoded signals over visible light, infrared light, other digital means of wireless broadcasting and projection technologies. For example, the encoded signals may include, but are not limited to, visible light encoded message communication, infrared encoded message communication or radio-wave-based encoded digital message broadcasting. The encoded message can be determined based on a given situation, e.g., a traffic situation, and a scene analysis, wherein object recognition techniques like camera object recognition can be applied. The communication may be decoded and referenced with defined indication patterns to inform and indicate various information using augmented reality via Heads-up-Displays or via other types of displays. Such information being indicated may include service states of the vehicle 10 (e.g., establishing virtual coupling between a leader vehicle and a follower vehicle, decoupling of a follower vehicle from a leader vehicle, handing-off a connection among different vehicles in a current driving situation), a current status of the vehicle 10 (e.g., leader hand-off in one mile, smart or digital towing of three vehicles, blocked space for a follower vehicle, etc.), a coupling health or quality of a communication link between a leader vehicle and a follower vehicle (e.g., strong, moderate, weak) and intents of the involved vehicles (e.g., one leader and two follower vehicles will make lane change to a right lane or a U-turn).

Figure 4A:
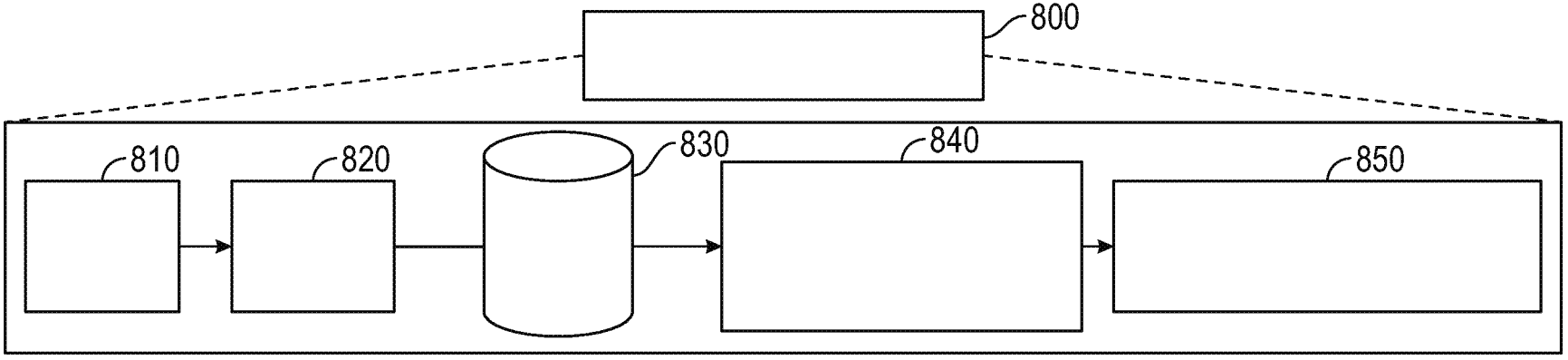
FIGS. 4*a* and 4*b* illustrate block diagrams showing steps carried out by the external device to visualize the current driving situation including the vehicle of FIG. 1 in accordance with an embodiment.
Figure 4B:
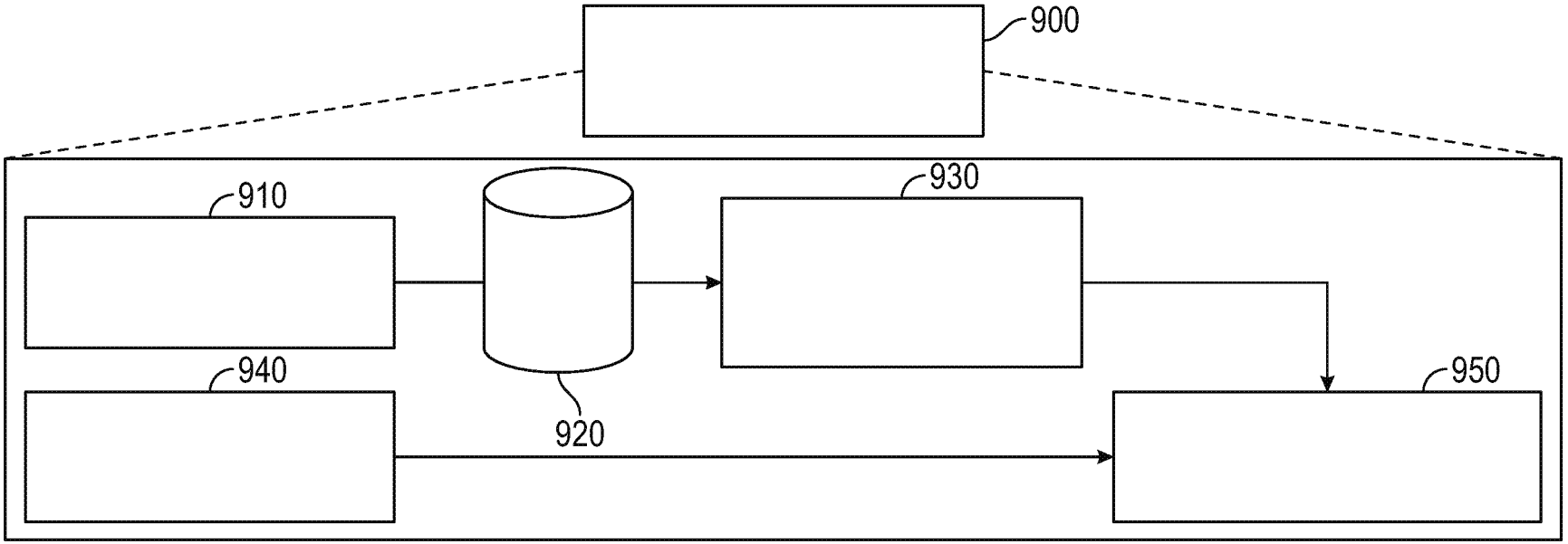

FIGS. 4*a* and 4*b* illustrates two methods 800 and 900 showing steps executed by the external device 48 to visualize a current driving situation, for example the driving situation 703 including vehicle 10 as described with reference to FIG. 3.

The method 800 of FIG. 4*a* illustrates a digital message broadcasting, for example in a "V2V" communication between vehicle 10 and external vehicle 48 (cf. FIG. 3). This method 800 may thus show the detailed actions carried out between the communication step at block 300 and the visualization step 700, which were both described with reference to FIG. 2. Now with reference to FIG. 4*a*, at block 810, the message including the encoded driving information from vehicle 10 is received at the external vehicle 48. At block 820, the vehicle 10 is identified by the second processor 60 of the external vehicle 48 and location data of vehicle 10 is determined. At block 830, indication types, i.e., predefined indication patterns, are referenced to associated driving situations, wherein corresponding references may be retrieved from a database. At block 840, an appropriate predefined indication pattern that represents an appropriate graphical indication augmentation for the current driving situation is selected based on the message and a policy mapping. In other words, the allocation of the predefined indication pattern to the decoded driving information is carried out by assigning the appropriate graphical indication augmentation for the current driving situation. For this allocation, a POMDP (Partially Observable Markov Decision Process) model or algorithm may be used. At block 850, augmented reality is used to visualize the indication pattern to the display 62 at the external vehicle 48. The display 62 may be a vehicle display, in particular a Heads-up-Display (HUD).

The method 900 of FIG. 4*b* illustrates a communication of the encoded driving information via an infrared signal. In this example, an encoded message in the form of an infrared light projection from the vehicle 10 is visible to a camera and/or thermal imaging sensors at the external device 48 (cf. FIG. 1). The external device 48 thus reads the infrared light message using its cameras or thermal imaging sensors at block 910. At block 920, the external device 48 then references indication types, i.e., predefined indication patterns to associated driving situations, wherein corresponding references may be retrieved from a database. At block 930, an appropriate predefined indication pattern that represents an appropriate graphical indication augmentation for the current driving situation is selected based on the message and a policy mapping. In other words, the allocation of the predefined indication pattern to the decoded driving information is carried out by assigning the appropriate graphical indication augmentation for the current driving situation. For this allocation, a POMDP (Partially Observable Markov Decision Process) model or algorithm may be used. At block 850, augmented reality is used to visualize the indication pattern to the display 62 at the external vehicle 48. The display 62 may be a vehicle display, in particular a Heads-up-Display (HUD). Block 940 shows that the infrared light signal may also be directly used to indicate the current driving situation, which is indicated by the connecting line between block 940 and block 950. The indication pattern as determined at block 930 can thus be fused with the information from the readings at block 940. Similar to block 910, block 940 includes reading, by the external device 48, the infrared light message using its cameras or thermal imaging sensors.

Figure 5:
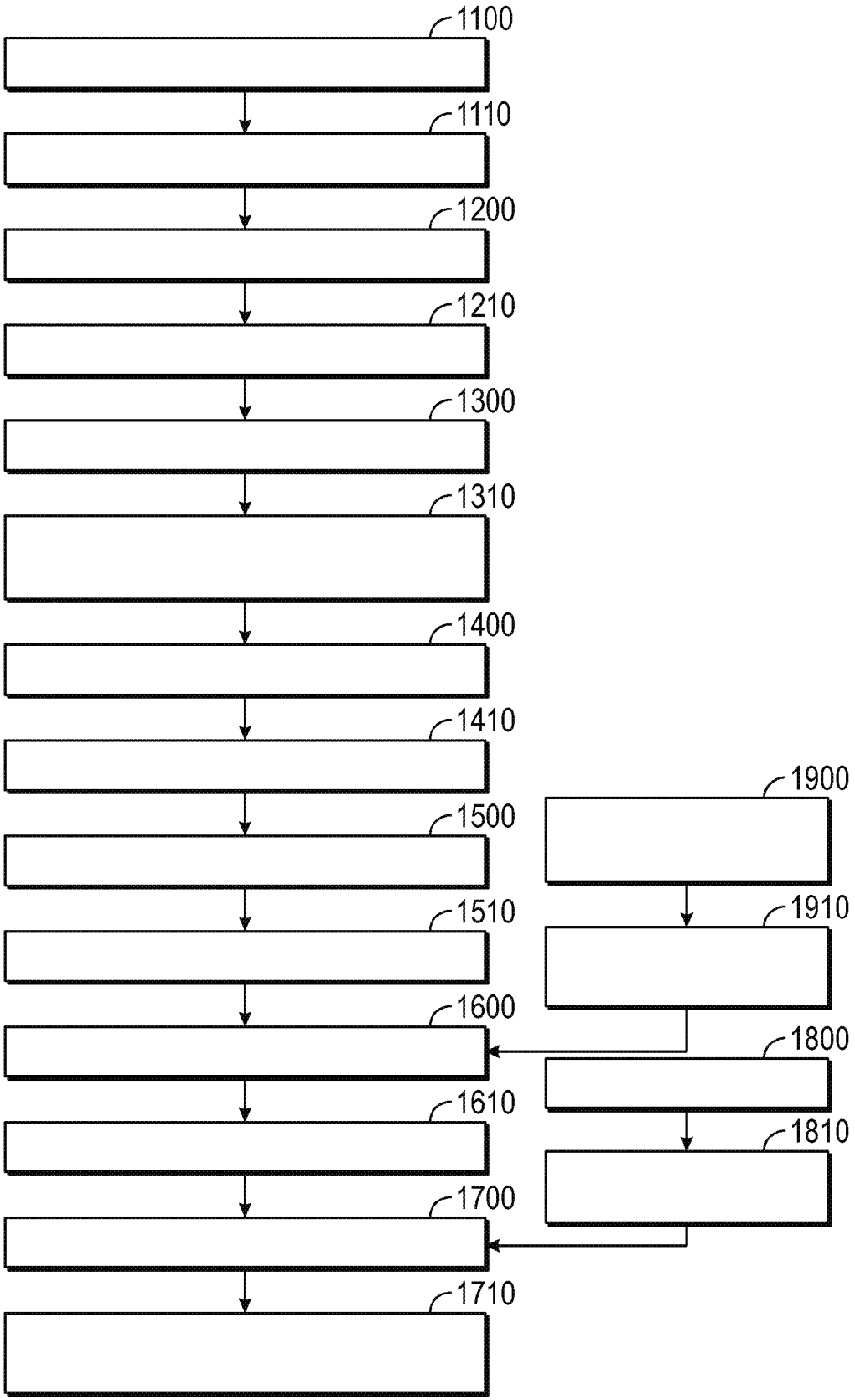
FIG. 5 illustrates a block diagram of a software architecture of a system for indicating a driving situation including the vehicle of FIG. 1, in accordance with an embodiment.

With reference now to FIG. 5, a dataflow diagram illustrates a software architecture of a system for indicating a driving situation including the vehicle 10 of FIG. 1. A driving information acquisition module 1100 obtains driving information 1110 of the at least one vehicle 10. The driving information 1110 includes information about an upcoming driving event involving the at least one vehicle 10. A driving information encoding module 1200 encodes the driving information 1110 in order to provide encoded driving information 1210. A communication module 1300 communicates the encoded driving information 1210 to the external device 48 of FIG. 1, wherein the communication is indicated by numeral 1310. A reception module 1400 receives the communicated encoded driving information 1310. The reception module 1400 then provides the received encoded driving information 1410 to a driving information decoding module 1500 which decodes the received encoded driving information 1410 in order to provide decoded driving information 1510. An allocation module 1600 determines a predefined indication pattern 1610 by allocating one of a plurality of predefined indication patterns to the decoded driving information 1510. Before the allocation is executed, an indication pattern definition module 1900 provides the plurality of predefined indication patterns 1910. A capturing module 1800 provides a current driving situation 1810. A visualization module 1700 provides a visualization 1710 of the current driving situation 1810 and predefined indication pattern 1610. The system that includes the above-described software architecture thus provides an enhanced vehicle indication system between participating and non-participating entities. In particular, a situation and scene-based decision on the type of information to be communicated can be provided.

Figure 6A:
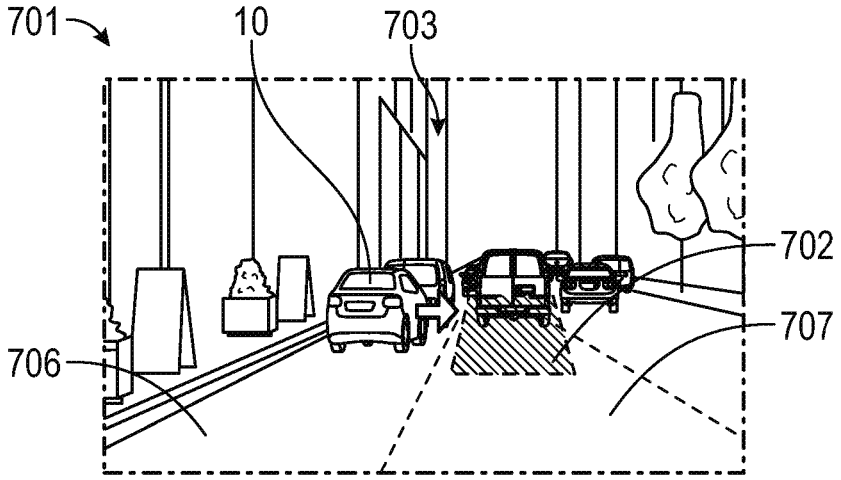
FIGS. 6*a* and 6*b* illustrate further details of the visualization indicating the driving situation as illustrated in FIG. 3, in accordance with an embodiment.
Figure 6B:
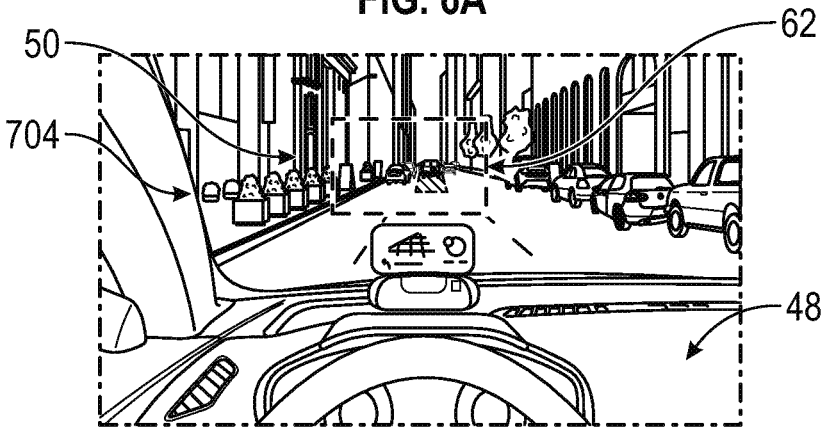

FIGS. 6*a* and 6*b* illustrate a detailed view of the visualization 701 indicating the driving situation 703 illustrated also in FIG. 3. FIG. 6*a* illustrates a detailed view of the visualization 701 on display 62 shown in FIG. 6*b*. FIG. 6*b* is essentially the same as the illustration of FIG. 3. The display 62 is again integrated in or is part of the external device 48. The external device 48 is again an external vehicle 48 driving on the same road as vehicle 10. Vehicle 10 is driving in front of the external vehicle 48 in the current driving situation 703. The current driving situation 703 is represented by the real-world scene 50 as it is seen by a driver of the external vehicle 48 through the front shield window 704 of the external vehicle 48. The visualization 701 may be the visualization as described with reference to block 700 of FIG. 2 above. The visualization 701 indicates the driving situation 703 including the vehicle 10 driving in front. The first processor of vehicle 10 may determine that the vehicle 10 is currently in a cruising operation in which vehicle 10 performs straight driving on the left lane 706. After this determination by the first processor of vehicle 10, further information of the cruising operation can be determined including an upcoming driving event of vehicle 10. The upcoming driving event may indicate that vehicle 10 will perform a lane change to the right lane 707 within a given time period such that vehicle 10 will be driving on the same lane 707 as the external vehicle 48 and in front of the external vehicle 48. This upcoming driving event may then be communicated by the first processor of vehicle 10 to the external vehicle 48 such that the second processor of the external vehicle 48 may determine an appropriate predefined indication pattern 702 for the lane change maneuver of vehicle 10. The predefined indication pattern 702 is a graphical representation as shown in FIG. 6*a* that indicates the current driving situation 703, i.e., the cruising operation of vehicle 10, and/or indicates the upcoming driving event involving the vehicle 10 making a lane change from the left lane 706 to the center lane 707 (the lane change is indicated by an arrow in FIG. 6*b*). In this case, the predefined indication pattern 702 indicates a virtual area or virtual space visualized on the display 62 such that the user, i.e., driver, of the external vehicle 48 recognizes that the area or space in front of the external vehicle 48 must remain reserved or unoccupied in order for vehicle 10 to perform the lane change. Thus, the current driving situation 703 includes an indication of the vehicle 10 together with the predefined indication pattern 702 on the display 62 of the external vehicle 48, wherein the predefined indication pattern 702 is a graphical representation of the upcoming driving event that requires the area or space indicated by this graphical representation to remain unoccupied. In an example, the external vehicle 48 may thus automatically decelerate or decelerate after manual input by its driver, such that the area or space indicated by the predefined indication pattern 702 remains unoccupied, for example as long as the predefined indication pattern is indicated. This process may be extended to all external vehicles of a plurality of external vehicles near or in the vicinity of the current driving situation 703 of vehicle 10 such that all these external vehicles receive the encoded driving information in the same manner as explained above and can provide an indication to their users that the specific area or space covered by the predefined indication pattern must remain unoccupied.

Figure 7:
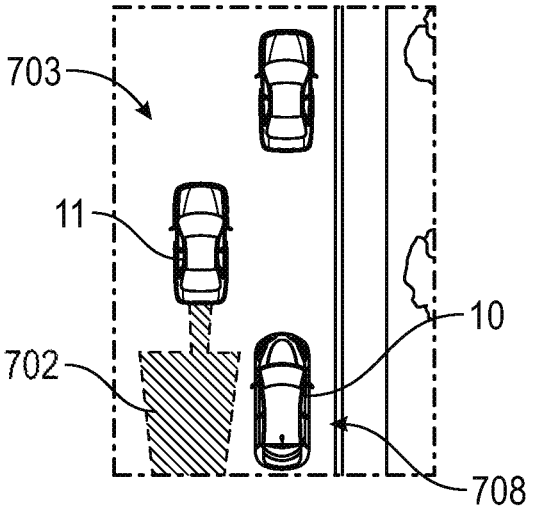
FIG. 7 illustrates a driving situation including a digital towing operation, in accordance with an embodiment.

FIG. 7 schematically illustrates a top view of a further driving situation 703, including a digital towing operation in which a leader vehicle 11 digitally tows a follower vehicle 10. This example further shows a parking state of the follower vehicle 10 and the predefined indication pattern 702 in this example indicates an area or space besides the vehicle 10 that must remain unoccupied such that leader vehicle 11 can tow the follower vehicle 10 out of the parking position 708. The corresponding visualization on the display 62 of an external device 48 can be performed in the same manner as described with reference to FIGS. 2 to 6 above. However, it is possible that the top view as illustrated in FIG. 7 is visualized alternatively or in addition to a visualization type as for example shown in FIGS. 3 and 6. Further visualizations like the top view shown in FIG. 7 may be displayed. FIG. 7 may also illustrate a top view of a driving situation 703 in which the leader vehicle 11 digitally tows the follower vehicle 10 to park at a free parking slot. Therefore, corresponding indication patterns 702 may include graphical representations to indicate the upcoming parking operation or the upcoming de-parking (pulling) operation. For these operations, the process may be as follows: First, the leader vehicle 11 is positioned for parking/pulling. Then, a potential maneuvering spot is identified for the follower vehicle 10. Then, the follower vehicle's 10 indication capabilities as well as calibrations are determined. Then, the appropriate indication pattern configuration and policy is identified based on multiple parameters using, for example the above-described POMDP decision model. Then, the visualization of the current driving situation 703 together with the graphical representation of the indication pattern 702 is provided to the external device 48. In an example, the indication pattern 702 can also be provided directly by the first processor utilizing the projection means, e.g., a display, for indication and in addition through an encoded signal exchange such that the second processor decodes the encoded information in order to display the indication.

The example of FIG. 7 outlines a digital towing operation. It should be understood that such a digital towing operation may not include any physical couplings between the leader vehicle 11 and the follower vehicle 10, but rather includes a virtual communication coupling or link between the vehicles 10 and 11 that is based on wireless "V2V" communication as described above. The indication states or graphical representations 702 indicating the states of the towing operation may be divided into different sub-states that can be indicated during the visualization. A first sub-state may indicate a smart towing stage "Start & End" which may include an indication to pull the follower vehicle 10 out of parking and an indication to park the follower vehicle 10. A second sub-state may indicate the smart towing stage "Exception Handling" which may include an indication that the towing operation is suspended. A third sub-state may indicate the smart towing stage "On going" which includes an indication of an "In-Lane Stable State", a "Leader Vehicle Change State", a "Lane Change State", a "Highway Entering & Exit State", etc.

Figure 8:
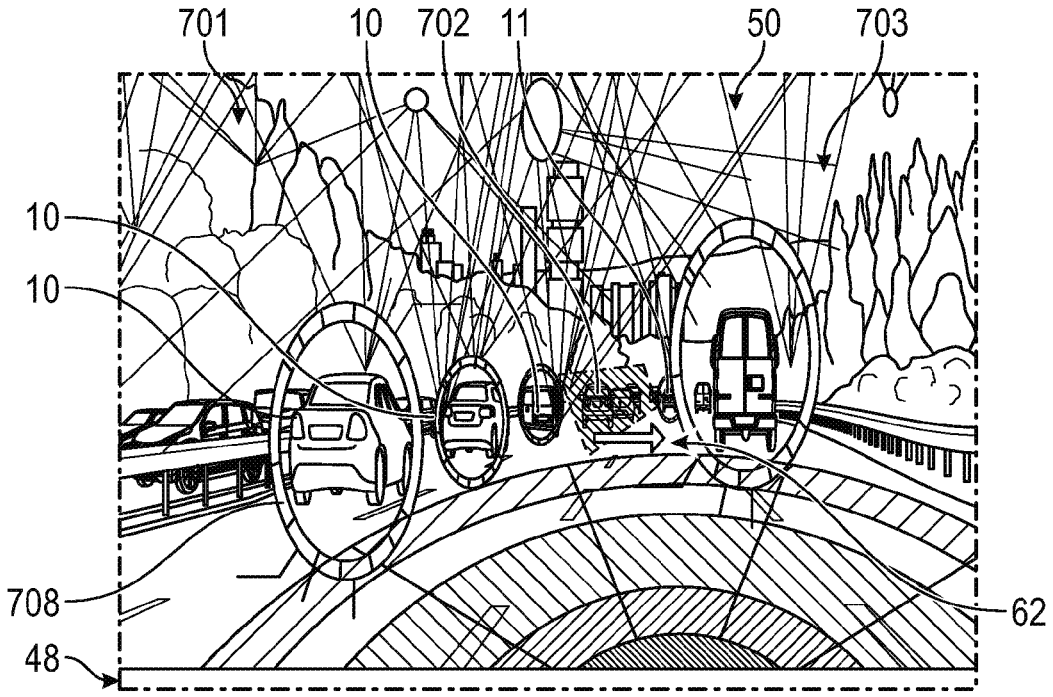
FIG. 8 illustrates a visualization of a further driving situation including a plurality of involved vehicles, in accordance with an embodiment.

FIG. 8 schematically illustrates a visualization 701 of a further driving situation 703 including a plurality of involved vehicles 10, 11. The plurality of involved vehicles may include any number of vehicles. In the illustrates case, several follower vehicles 10 follow one leader vehicle 11. The illustration of FIG. 8 represents a view of a user of an external vehicle 48 through the windshield of the external vehicle 48. The user can thus view the driving situation 703 through the windshield. The windshield may further include a display or display section 62 having a display area in which a visualization 701 of the driving situation 703 overlaid with a predefined indication pattern 702, e.g., a graphical representation, that indicates a digital towing operation between the plurality of follower vehicles 10 and the leader vehicle 11. In this case, the predefined indication pattern 702 indicates that a digital towing operation is in progress and reserves a virtual area or space projected into the real-world scene 50 of the current driving situation 703 using augmented reality. Thus, the current driving situation 703 includes an indication of the vehicles 10 and 11, together with the predefined indication pattern 702 on the display 62 of the external vehicle 48. In particular, the driving situation 703 including the vehicles 10 is visualized within the real-world environment 50 as seen through the windshield of the external vehicle 48 enhanced by the predefined indication pattern 702. The predefined indication pattern 702 includes an additional arrow to indicate to the user of the external vehicle 48 that the follower vehicles 10 will perform a lane change from a left lane to one of the center lanes of the road which may collide with a driving path of the external vehicle 48. In this manner, the user of the external device 48 can readily evaluate the upcoming driving event in which the follower vehicles 10 will perform the lane change such that, based on the indications presented on the display 62, the user of the external device 48 can anticipate the current driving situation 703 and the following driving maneuvers of the surrounding vehicles 10 and 11. For a better visualization of all vehicles 10 and 11 involved in the driving situation 703, i.e., in the digital towing operation, the involved vehicles 10 and 11 may be marked with a graphical indication which is also part of the predefined indication pattern. This marking 708 may be a circle encircling the vehicles as illustrated in FIG. 8 or any other element having a different shape.

Figure 9:
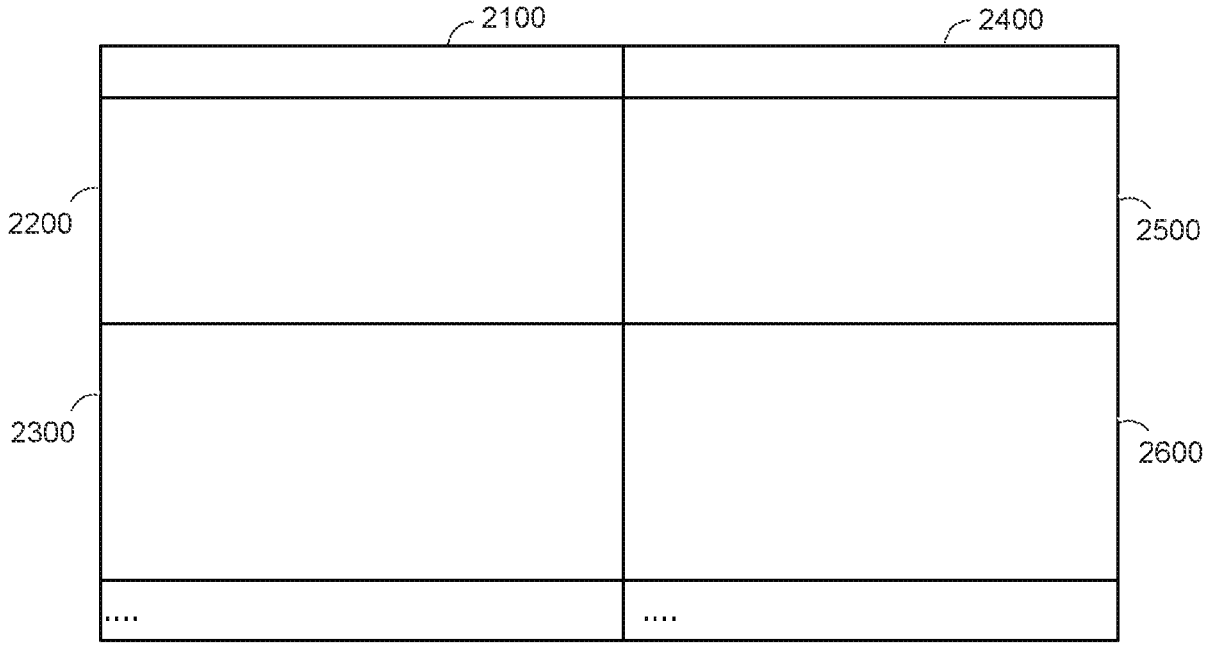
FIG. 9 illustrates a table showing possible encoding schemes for different driving information, in accordance with an embodiment.

FIG. 9 illustrates a table showing possible encoding schemes for different driving information. The encoded message 2100 that comprises the encoded driving information 2200, 2300 may include a bit vector or bit string, wherein the bit vector includes at least information about the current driving operation of the at least one vehicle and the intended driving operation of the at least one vehicle. Furthermore, the bit vector includes information about the number of vehicles involved in the upcoming driving event and a target position of the involved vehicles. For example, bits 1, 2, 3 and 4 include the information about the mode or state, i.e., the current driving information, of the vehicle 10 (cf. FIGS. 1, 3, 6, 7 and 8). Bits 5 and 6 include the information about the number of vehicles involved in the driving situation, for example the number of follower vehicles 10. Bits 7 and 8 include the information about the intended driving operation of the vehicle 10, for example a direction or type of lane change. Bits 9 and 10 include the information about the target position of the vehicle 10, for example the target lane of travel. Additional information can be encoded in this manner. The table also specifies the corresponding content 2500, 2600 that will be displayed in the indication area 2400 for each encoded driving information 2200, 2300.

In detail: FIG. 9 shows in the first row 2200 of the table a first example having a bit string "1001" for bits 1 to 4 which encodes the current driving situation, i.e., a trip operation or a cruising operation of the vehicle 10. The first four bits are followed by the bit string "01" which encodes the number of follower vehicles 10, in this case one follower vehicle 10 as for example shown in the scenario of FIG. 6. The fifth and sixth bits are followed by the bit string "01" which encodes the intended driving operation of the follower vehicle 10, in this case a lane change from a left lane to a right lane as also shown in the scenario of FIGS. 6*a* and 6*b*. The seventh and eighth bits are followed by the bit string "10" which encodes the target position of the follower vehicle 10, in this case lane three.

FIG. 9 shows in the second row 2300 of the table a second example having the same bit vector as in the first example of the first row, except the fifth and sixth bits which in this case include the bit string "10" that encodes that the number of follower vehicles 10 is two.

The encoding may also be accomplished using several other techniques. For example, the follower vehicle 10 can provide a defined blinking pattern via LED lights or bulb lights mounted to the follower vehicle 10. For different driving information, the blinking pattern of the LEDs or bulbs may be different such that each driving information can be encoded using a unique blinking pattern. Different encodings may also be accomplished using different time sequences or differently timed blinking patterns.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method of indicating a driving situation including at least one vehicle to an external device, comprising:

obtaining, by a first processor, driving information, the driving information including information about an upcoming driving event involving the at least one vehicle;

encoding, by the first processor, the driving information to provide encoded driving information;

communicating, by the first processor, the encoded driving information to the external device;

receiving the encoded driving information at the external device and providing the encoded driving information to a second processor;

decoding, by the second processor, the encoded driving information to provide decoded driving information;

allocating, by the second processor, a predefined indication pattern to the decoded driving information, the predefined indication pattern including a graphical representation of the upcoming driving event involving the at least one vehicle; and visualizing, at the external device, a current driving situation including the at least one vehicle together with the predefined indication pattern.

2. The method of claim 1, wherein the information about the upcoming driving event is determined based on a current driving operation of the at least one vehicle and an intended driving operation of the at least one vehicle.

3. The method of claim 2, encoding, by the first processor, the driving information using a bit vector, wherein the bit vector includes at least information about the current driving operation of the at least one vehicle and the intended driving operation of the at least one vehicle.

4. The method of claim 1, wherein the information about the upcoming driving event includes information about a number of vehicles involved in the upcoming driving event and a target position of the involved vehicles.

5. The method of claim 1, wherein communicating, by the first processor, the encoded driving information to the external device includes communicating the encoded driving information using at least one of a visual signal, an acoustic signal, a radio frequency signal and an infrared signal.

6. The method of claim 1, wherein the external device is a mobile platform in the environment of the at least one vehicle and spatially separated from the at least one vehicle.

7. The method of claim 1, wherein the external device comprises the second processor.

8. The method of claim 1, providing a list of possible predefined indication patterns by at least one of a server that is spatially separated from the external device and a data storage that is integrated into the external device, wherein each predefined indication pattern of the list of predefined indication patterns is referenced to a particular driving information.

9. The method of claim 8, wherein allocating, by the second processor, the predefined indication pattern to the decoded driving information includes selecting a predefined indication pattern from the list of possible predefined indication patterns.

10. The method of claim 1, providing, by the second processor, the predefined indication pattern using at least one of a Markov decision process and a deep learning process.

11. The method of claim 1, wherein the predefined indication pattern is indicative of a type of the graphical representation of the upcoming driving event involving the at least one vehicle.

12. The method of claim 1, visualizing the current driving situation including the at least one vehicle together with the predefined indication pattern at a display of the external device using augmented reality.

13. The method of claim 12, wherein the driving situation including the at least one vehicle is visualized as a real-world environment enhanced by the predefined indication pattern.

14. The method of claim 13, determining, by the second processor, a projection zone that defines a region at the display in which the predefined indication pattern is visualized.

15. The method of claim 14, wherein the predefined indication pattern displayed within the projection zone is a visualization on the display indicating a location with respect to the real-world environment in which the at least one vehicle will be maneuvering during the upcoming driving event.

16. The method of claim 1, determining, by the second processor, a point in time at which the predefined indication pattern is to be visualized at the external device based on a current traffic situation around external device.

17. The method of claim 1, determining, by the second processor, a reliability of the visualized predefined indication pattern, the reliability being indicative of a quality of the driving information obtained by the first processor.

18. The method of claim 1, wherein the at least one vehicle comprises a leader vehicle and a follower vehicle;

wherein the driving information includes information about a digital towing operation including the leader vehicle and the follower vehicle; and wherein the predefined indication pattern indicates an upcoming maneuver of the follower vehicle.

19. A system for indicating a driving situation including at least one vehicle, comprising:

a first processor, a second processor and an external device;

wherein the first processor is configured to:

obtain driving information, the driving information including information about an upcoming driving event involving the at least one vehicle;

encode the driving information in order to provide encoded driving information;

communicate the encoded driving information to the second processor;

wherein the second processor configured to:

receive the encoded driving information;

decode the encoded driving information in order to provide decoded driving information;

allocate a predefined indication pattern to the decoded driving information, the predefined indication pattern including a graphical representation of the upcoming driving event involving the at least one vehicle; and wherein the external device is configured to visualize a current driving situation including the at least one vehicle together with the predefined indication pattern.

20. The system of claim 19, wherein the external device is an external vehicle; and wherein the second processor is located on the external vehicle.

* * * * *